US005588283A

United States Patent [19]

Martin

[11] Patent Number: 5,588,283

[45] Date of Patent: Dec. 31, 1996

[54] LIDDING MACHINE

[75] Inventor: Herman W. Martin, Aldergrove, Canada

[73] Assignee: Ropak Canada Inc., Delta, Canada

[21] Appl. No.: 483,758

[22] Filed: Jun. 7, 1995

[51] Int. Cl.[6] ..... B67B 1/04; B67B 3/22; B65B 7/28

[52] U.S. Cl. ..... 53/486; 53/289; 53/319

[58] Field of Search ..... 53/488, 289, 366, 53/367, 485, 323, 328, 486, 319

[56] References Cited

U.S. PATENT DOCUMENTS

| | | | |
|---|---|---|---|
| 2,894,361 | 7/1959 | Ullman et al. | 53/289 X |
| 3,295,293 | 1/1967 | Lodding | 53/289 X |
| 3,383,834 | 5/1968 | Switliski et al. | 53/289 X |
| 3,408,787 | 11/1968 | Mueller | 53/289 X |
| 3,412,526 | 11/1968 | Bennert et al. | 53/289 |
| 3,511,025 | 5/1970 | Newport | 53/367 X |

*Primary Examiner*—Horace M. Culver
*Attorney, Agent, or Firm*—Patrick Michael Dwyer

[57] ABSTRACT

A lidding and sealing machine for a pail. A pail holding tool set in or on a base and a lid press plate slidably engaged in a bridge on the same base align the pail and the lid for sealing when pressed together. Alignment guides depending from the edges of the press plate engage the lip flanges of the pail and conform the pail lip shape to the lid sealing surface shape even if the pail is distended with the fullness of its contents so its lip is not congruent to the lid sealing surface. A plug insertion tool forces a plug into the pail's drain in a connected and sequential action that is part of the lidding action.

9 Claims, 6 Drawing Sheets

LIDDING MACHINE

TECHNICAL FIELD

The invention relates to the field of packaging and food processing; more particularly, it relates to container closure and sealing machinery and especially to a method and apparatus for a container lidding machine.

BACKGROUND OF THE INVENTION

Every year during the Salmon fishing season in the Pacific waters of the coast of Alaska and elsewhere, millions of dollars of Salmon are caught and processed for consumption all over the world. One Salmon product likely not well known in the U.S. but highly regarded in Japan is the premium, unopened roe sacks from the female Salmon, called in Japan simply sujiko.

This product is so highly sought that one well packed, undamaged 5 kg. container can be worth $350 or more. Setting aside the details of the processing of the sujiko itself, one of the most critical stages is the method and manner of packaging, for the visual appeal to the Japanese buyer when the container is opened is of primary importance to the value of the product.

A decade or more ago, wooden 5 and 10 kg. crates were the container of choice; now that container has been supplanted by plastic pails with sealable lids. These pails are typically more or less rectangular in shape (slightly trapezoidal, for ease of palletizing, would be more accurate), and have had developed for them by leaders in the plastic container industry very sophisticated lid sealing methodologies and mechanisms.

Because the sujiko is soaked in brine as part of the final processing, and because the natural product releases its own juices, a properly packed pail of sujiko product must be drained thoroughly before it is finally sealed for shipment. In older times, the wooden crates filled with fresh product wold simply be turned upside down on plastic to drain before lidding. The better plastic pails now use a drain hole in the bottom, which is sealed with a resilient plastic plug that is press snapped into the drain hole after the product has sufficiently drained for shipment.

Typically, for reasons of weight conservation and other reasons, the plastic containers, though sturdily and artfully made and reinforced to an extent, are of a light enough gauge that a fully loaded pail of sujiko has its longer rectangular sides somewhat bowed out, to an extent that the lid designed for the pail does not ready fit onto the full pail. The pail closing and sealing process is conventionally therefore a manual operation, as is the final step of plug insertion into the drain, requiring a worker whose hands have been soaked in Salmon brine for as much as eighteen hours at a time to manipulate the bowed sides of the pail into conformity with the lid, while applying pressure downwardly on the lid to get it closed and sealed, sometimes not without the aid of a rubber hammer. When the pail is deemed fully drained after closure, the final draining being hastened by the slight compression of the product as the lid is forced on, the plug is finger inserted into the drain opening, and hammered home.

The process is tedious, inexact, time consuming and painful to the workers hands. Not infrequently, a faulty closed pail either springs open damaging or destroying the valuable product inside, or leaks during shipment to present a most unattractive appearance and smell at the docks in Japan to the buyers waiting there for the product to arrive.

What is needed is a machine to quickly and precisely receive the full containers of sujiko, with lids hand placed and started, and then close and seal them and insert the plug all in one simple and relatively effortless operation that does not require prolonged soaking of the workers hands in the brine. Such a machine should virtually insure the safe and undamaged arrival in Japan of gleaming white pallets of pristine sujiko pails.

DISCLOSURE OF THE INVENTION

Accordingly, it is an object of the invention to provide a machine to quickly and precisely receive the full containers of sujiko, with lids manually placed and started at several corners, and then close and seal them and insert the plug all in one simple and relatively effortless operation that does not require prolonged soaking of the workers hands in the brine.

It is a further object of the invention to provide such a machine to virtually insure the safe and undamaged arrival in Japan of the sujiko pails.

It is yet another object of the invention to meet any or all of the needs summarized above.

These and such other objects of the invention as will become evident from the disclosure below are met by the invention disclosed herein.

The invention addresses and provides such a system. The invention represents the first successful attempt to mechanize a conventionally manual process, a process that under the best of circumstances is tedious and irksome for the workers, and that leads inevitably to lost value in the delivered product.

Application of the invention to closure and sealing of the sujiko pails is especially beneficial in that the invention is the only system that effectively provides a semi automated container closure process in the industry for processing and shipment of sujiko, and which addresses the unique circumstances and requirement of the packaging of sujiko in conventional plastic pails.

In broadest terms the invention is lidding and sealing machine for a pail. A pail holding tool set in or on a base and a lid press plate slidably engaged in a bridge on the same base align the pail and the lid for sealing when pressed together. Alignment guides depending from the edges of the press plate engage the lip flanges of the pail and conform the pail lip shape to the lid sealing surface shape even if the pail is distended with the fullness of its contents so its lip is not congruent to the lid sealing surface. A plug insertion tool forces a plug into the pail's drain in a connected and sequential action that is part of the lidding action.

The invention presents an apparatus for lidding and sealing a resilient pail that has both a sealing lip and a lip flange. The sealing lip is generally synonymous with the pail's upper rim, and the flange in conventional sujiko pails is an outward perpendicular projection from the pail sides, generally circumferentially surrounding the pail, about a half inch below the rim. The lid has a mating lip sealing surface corresponding to the pail lip, as will be appreciated by those skilled in the art. The apparatus comprises a pail holding tool in a base, and a lid press plate that is slidably engaged in a bridge over the base. The pail holding tool may simply be alignment guides or stops on a heavy base plate, and the lid press plate is generally mounted parallel to the base and driven by a shaft that slides through a bridge that spans the base. The press plate when actuated moves in a direction normal to the base and has a set of tapered alignment guides depending from its edges for engaging the lip flanges of the pail to bend and conform the pail lip shape back to its normal rectangular shape that is the same as that of the lid lip sealing surface. As the lid is pressed by the plate down onto the pail, the pail is pressed back into rectangular shape and the lip and lip sealing surface can freely engage and seal. The number and position of the alignment guides on the lid press plate may vary, though four are found to be effective when space around the periphery of the plate, one to a side.

The apparatus also advantageously has a plug insert tool that operates within in a plug well in the base. Preferably, the plug insert tool is driven by the same downward force on the lid press plate to force a plug up into a drain in the pail. To this end in preferred embodiments, the apparatus also has a pushrod or sheave that is slidably engaged vertically on the bridge and connected or engaged by the lid press plate, or an extension of it, after the press plate has started downward.

This may be accomplished through the use of a plug lever pivotally engaged in the base and actuated by the pushrod to push the plug up into the drain from out of a plug well where the plug is positioned before the operation begins. The connection in preferred embodiments between the lid press plate and the pushrod is effected by a lid press handle that operates the press plate, and that also engages the pushrod after the lid press plate starts to press the lid onto the pail.

The invention also presents a method of sealing a resilient container with a lid when the container is full and distended or bowed so that a container lip is not congruent to a lid sealing surface shape. In the method the following steps are carried out:

a. placing the lid loosely on the container, corners oriented to corners, with at least two respective corners aligned;

b. aligning the container in a container tool;

c. pressing the lid onto the container by applying a downward pressure to the lid while applying an outside in pressure on the bowed sides of the container with a single lid tool;

d. releasing the lid tool; and e. removing the sealed container from the container tool.

Optionally the method can also be used to insert a plug into the pail drain of the container, by performing an additional step, between the steps c. and d., namely:

pressing the plug into the drain using the same actuating force used to press the lid onto the container.

BEST MODE OF CARRYING OUT THE INVENTION

Figure 1:
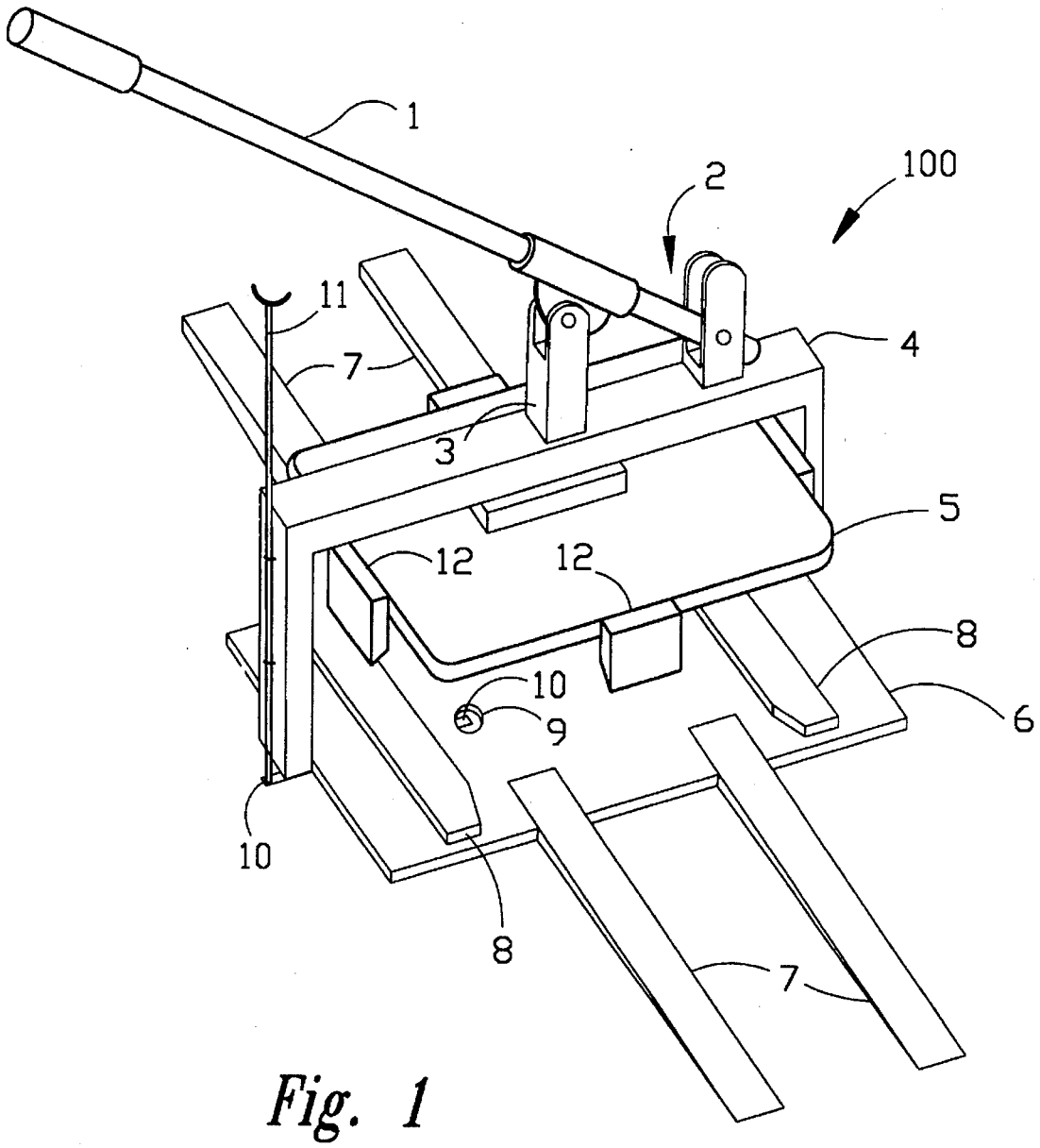
FIG. 1 is an isometric view of a preferred embodiment of the invention.

Turning now to the drawings, the invention will be described in a preferred embodiment by reference to the numerals of the drawing figures wherein like numbers indicate like parts.

Through out the description, the terms "down", "downward", "up", and "upward" are used in the sense that a container or pail is generally, though not necessarily worked on as it sits on a horizontal surface. Thus "down" with respect to the pail generally means to move in the direction of the bottom of the pail from somewhere above and outside the pail; and "up" generally means above the top of the pail, outside of the lid, or toward the bottom of the pails from outside and below it. "Normal", when used as a directional term means generally perpendicular to the referenced plane or surface.

Figure 2:
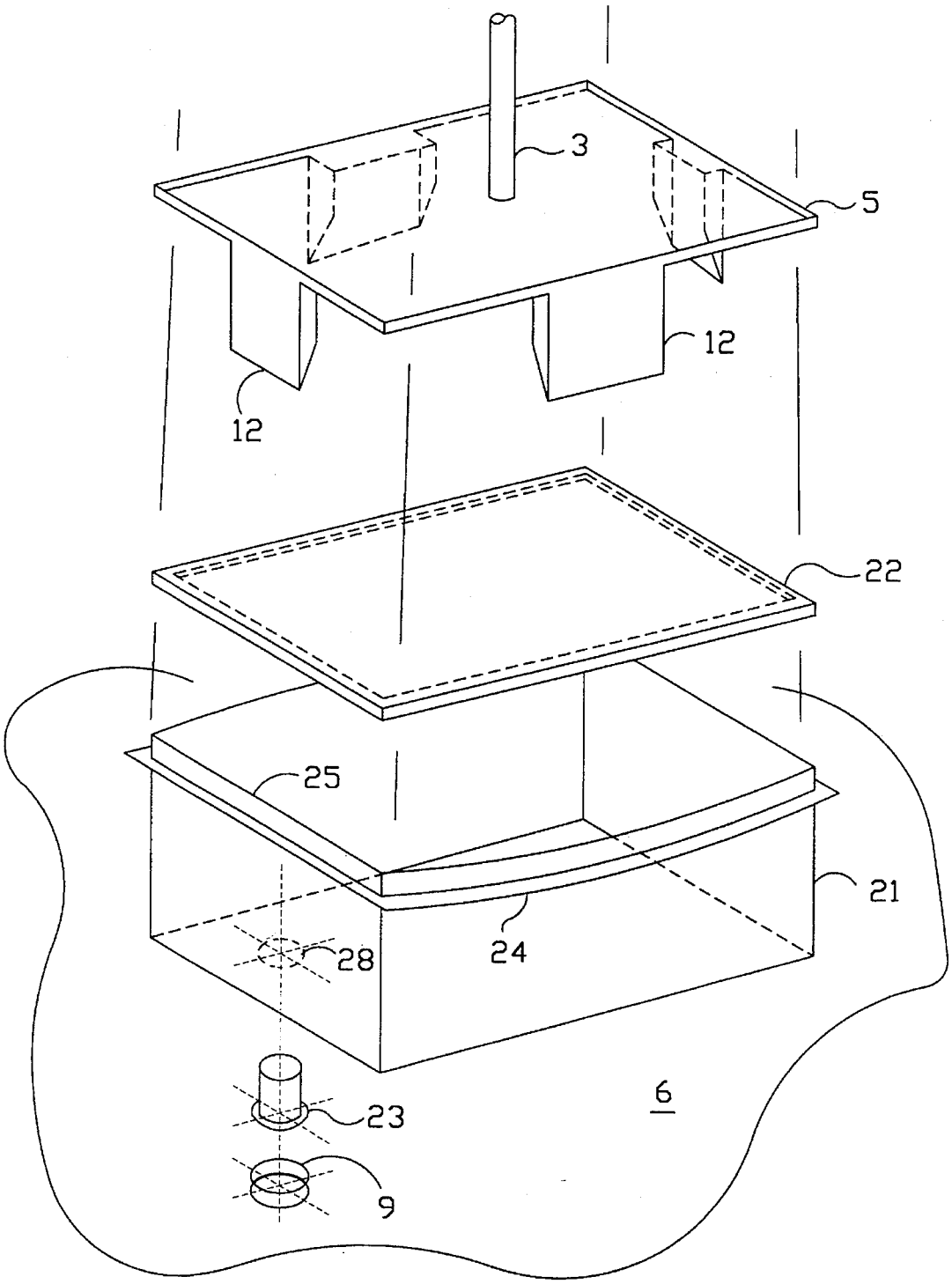
FIG. 2 is an exploded isometric and schematic illustration of an aspect of the preferred embodiment of the invention in FIG. 1.

FIG. 1 shows a preferred embodiment of the lidding machine. Handle 1 is attached to plunger shaft 3 through linkage 2, and pivots on bridge 4. When handle 1 is pulled down, shaft 3 pushes press plate 5 downwardly toward base 6. FIG. 2 shows a simplified schematic of this operation, as when plate 5 moves downwardly to press lid 22 onto pail 21 which sits on base 6.

Figure 6:
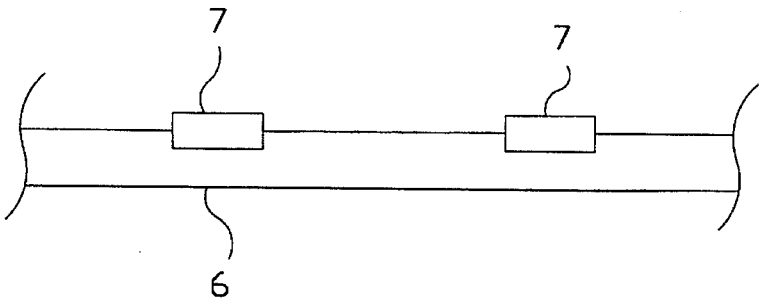
FIG. 6 is a partial end sectional elevation of an aspect of the invention.

Base 6 also preferably incorporates rails 7 which fit into cut outs on base 6 so that they are preferably almost flush with the upper surface of base 6, but not quite (see also FIG. 6). This slight protrusion of one or more of rails 7 above base 6 advantageously form end stops to guide the pail 21 into an aligned position with press plate 5 and plug well 9. Raised side guides 8 accomplish a like purpose on the sides. When pail 21 is set on rails 7 to the left of lidding machine 100, it may freely be slid until it drops off the end of the rails, onto the base 6, and up against the right side rail stops, all in between side guides 8.

In this aligned position, pail 21 is ready to receive pressure from press plate 5, with alignment guides 12 now in position to have their tapered inner surfaces (see also FIGS. 3 and 4) make contact with the pail's flange 24 and gradually and forcefully compel the long sides of pail 21 to reassume their relatively straight and rectangular shapes, so that continued pressure on lid 22 from plate 5 can complete the lidding and sealing job.

Figure 7:
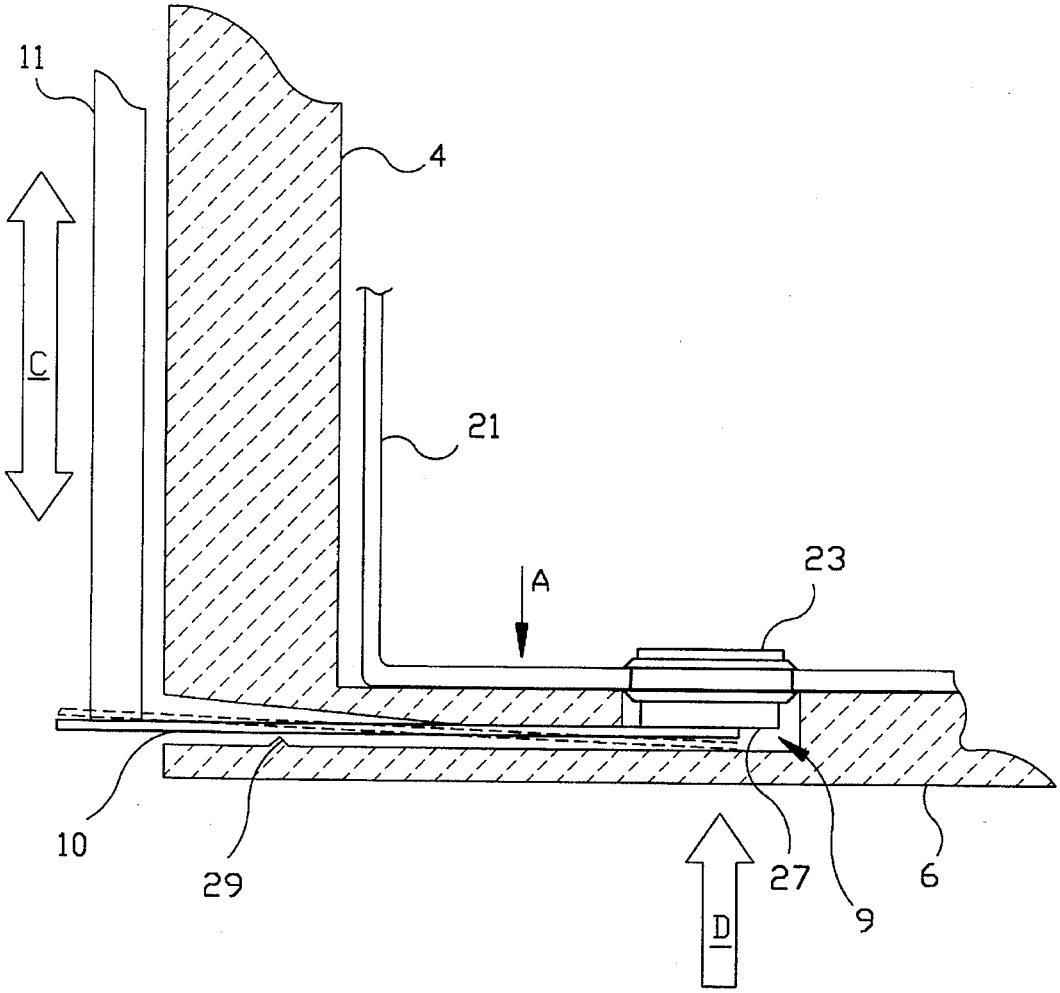
FIG. 7 is a partial end sectional elevation detail of a plug insertion aspect of the invention.

A plug well 9 in base 6 serves both as a receptacle for plug 23 preparatory to its insertion into drain 28 (see FIG. 2), and as an alignment tool for use by the plug insertion mechanism comprised of pushrod 11 and lever 10 (with optional spacer 27—see also FIG. 7). As handle 1 is pushed down and plate 6 make initial contact with lid 22, handle 1 is in position to make contact with pushrod 11. Further force applied to press lid 22 onto pail 21 is also simultaneously thereby applied to pushrod 11, which in turn pushes on one end of lever 10. The other end of lever ten in plug well 9 thus pushes up on spacer 27 to evenly distribute the force of the lever to plug 23 and press it up into drain 28.

Figure 5A:
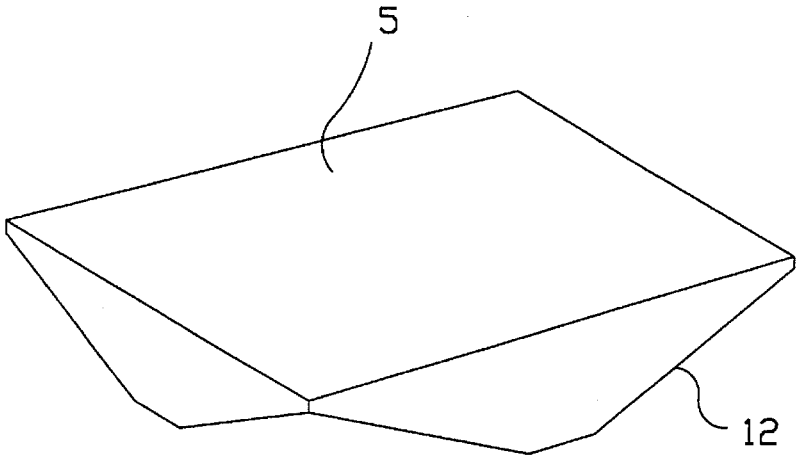
FIGS. 5*a–c* are alternate embodiments of an aspect of the invention.
Figure 5B:
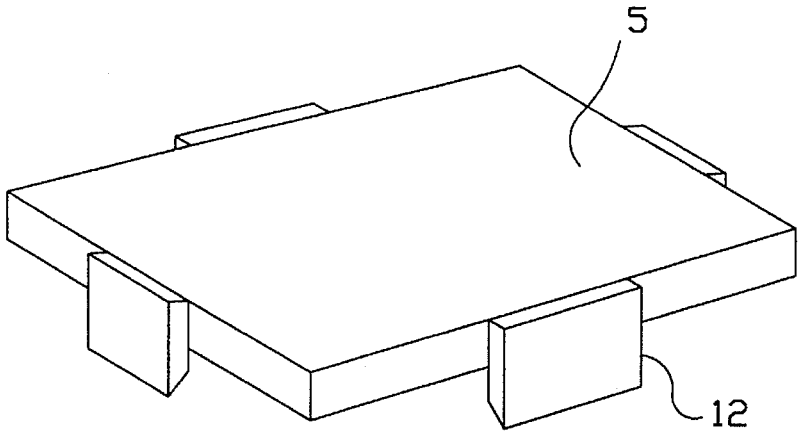
Figure 5C:
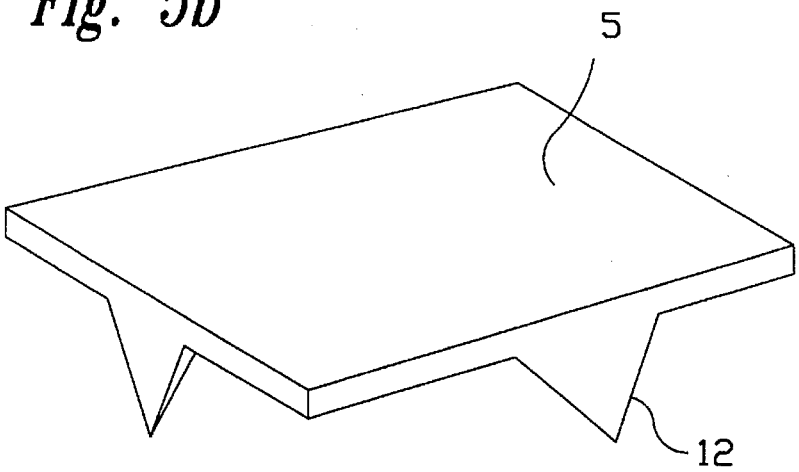

In FIG. 2, a preferred positioning of four alignment guides 12 may be seen. FIGS. 5*a*–5*c* illustrate that other shapes of alignment guide can be used as well, and that they can be mechanically attached or otherwise integral to plate 5.

Figure 3:
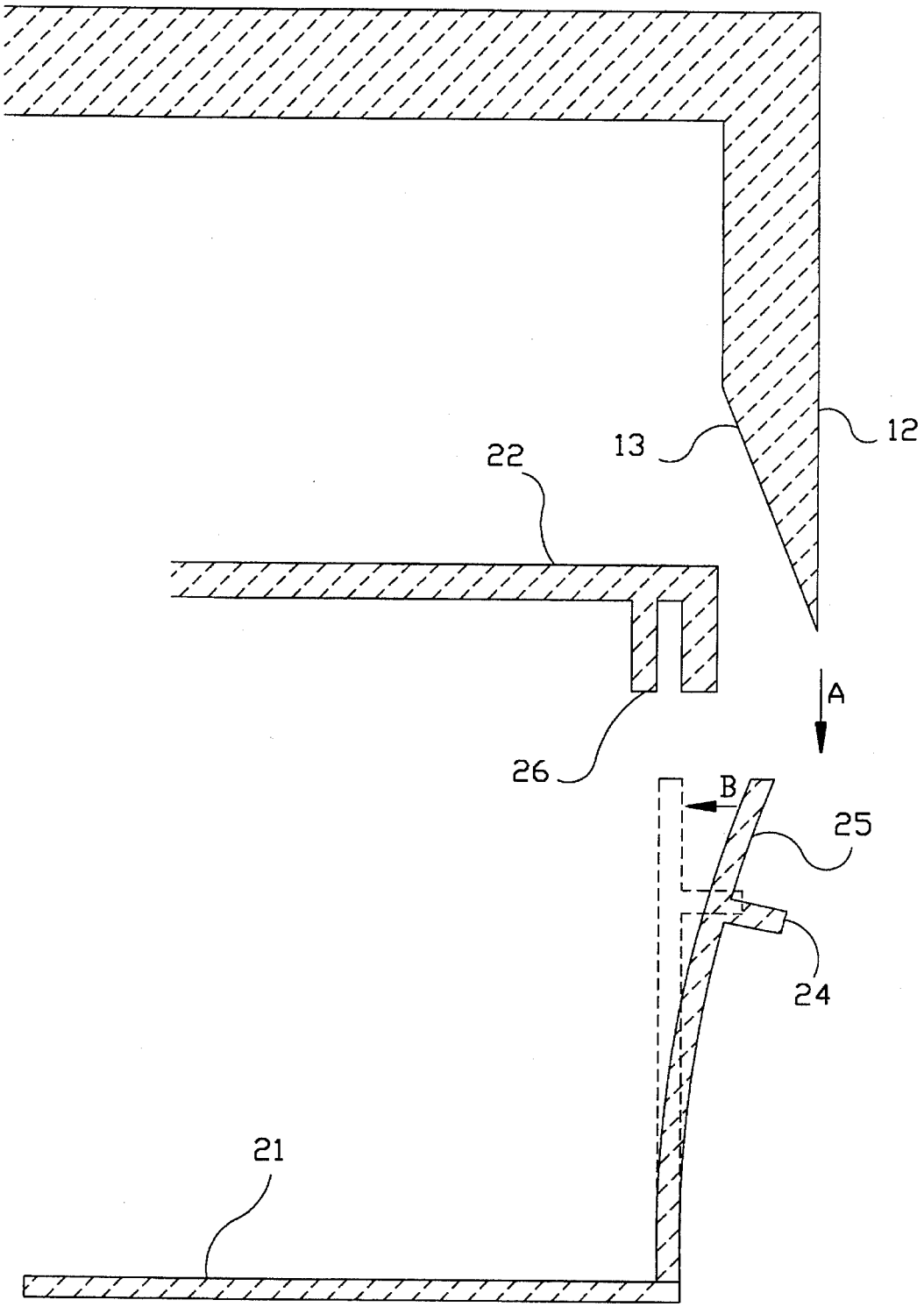
FIG. 3 is a sectional partial side elevation of the working of the invention upon a pail and lid.
Figure 4:
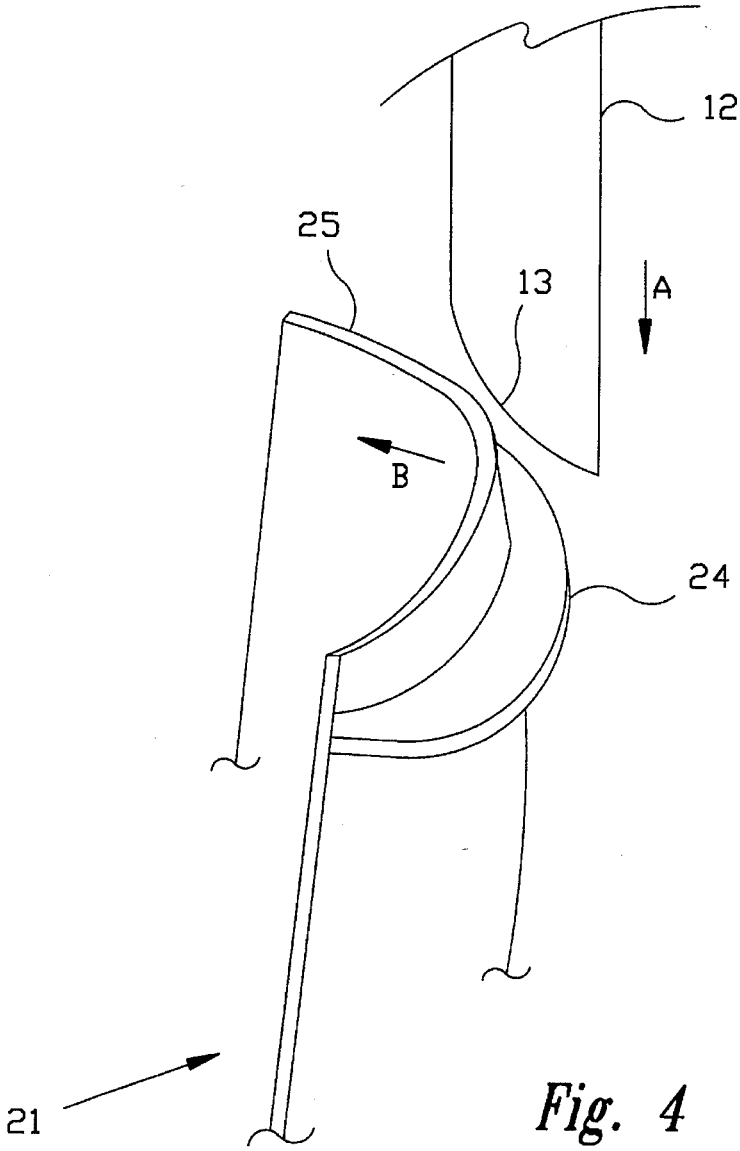
FIG. 4 is a schematic partial side view of the working of the invention upon a pail and lid.

FIGS. 3 and 4 together show the distended or bowed out side of pail 21 thus unable to have its lip 25 mate up with sealing surface 26 of lid 22. However, because flange 24 projects even further out than the bowed side of pail 21, it is the first to make contact with the inner tapered surface 13 of alignment guide 12. As guide 12 moves down in the direction of arrow A, a resultant force, as will be appreciated by those skilled in the art, is applied in the direction of arrow B to straighten, unbow, and conform the pail side, so that lip 25 is directed and aligned under sealing surface 26 just as lip 25 and surface 26 come into conjunction. Press plate 5 then drives lid 22 down fully onto lip 25 and pail 21 is sealed.

In FIG. 8 a detail of the plug lever 10 action on plug 23 is illustrated. Pushrod 11 pushes down on end of lever 10 at edge of base 6. Lever 10 pivots on fulcrum 29 so that its other end on which rest spacer 27 pushes up on plug 23, which is guided by plug well 9 up into drain 28. Because lid and paid are under greatest pressure from plate 5 just at the end of the sealing process with handle 1 fully down, there is adequate resistance to the insertion of plug 23 into drain 28 and the same force hold the pail and lid down (arrow A) is now also, through lever 10, pushing the plug up in the direction of arrow D. When handle 1 is released and pulled up, pushrod 11 is preferably spring loaded, in a manner well known in the art, to move upwardly again (arrow C) to release lever 10 and thus spacer 27.

With regard to systems and components above referred to, but not otherwise specified or described in detail herein, the workings and specifications of such systems and components and the manner in which they may be made or assembled or used, both cooperatively with each other and with the other elements of the invention described herein to effect the purposes herein disclosed, are all believed to be well within the knowledge of those skilled in the art. No concerted attempt to repeat here what is generally known to the artisan has therefore been made.

In operation, lidding machine 100 is preferably placed on a flat, solid table or equivalent base, with handle 1 facing the front (toward an operator). The machine is designed to flow product through the lidding/plugging operation from right to left. With handle 1 in the upright position, and a fresh plug inserted into plug well 9 in the right front corner of base 6, and a lid 22 placed on filled pail 21 so that two diagonally opposite corners can just be pressed down on their corresponding pail corners, and with the pail oriented so that its break tab is toward the back side, the pail is slid across the rails 7 from right to left until it drops into the stops on rails 7. The handle 1 is then pulled fully and firmly down to the stop (pushrod fully down), causing the lid to snap onto the pail completely and the plug to be insert in one motion. Handle I is then raised to the up position, the lid and container are checked, and the sealed unit is lifted slightly and slid out to the left. These steps are then repeated for continuous operation.

Machine 100 may be advantageously made of a number of commonly available structural and mechanical materials, fabrication from any particular material will not depart from the scope of the appended claims. The machine is presently made almost entirely from 6061 T6 aluminum which has been found to have an adequate strength to weight ratio. Springs, where employed, are generally standard stainless steel, as is plug lever 10. Spacer 27 is nylon. A preferred form of pushrod 11 is actually a sliding flat plate of aluminum with a delrin wear pad. The sliding plate slides along the front face of bridge 4 in a manner well known in the art.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

I claim:

1. An apparatus for lidding and sealing a resilient pail having a sealing lip and lip flange, with a lid having a lip sealing surface corresponding to the pail lip, comprising:

a. a pail holding tool in a base;

b. a lid press plate slidably engaged in a bridge on a base for sliding movement in a direction normal to the base while the lid press plate is substantially parallel to the base, the lid press plate having alignment guides depending from its edges for engaging the lip flanges of the pail and conforming the pail lip shape to the lid sealing surface shape as the lid is pressed by the plate onto the pail.

2. The apparatus of claim 1 further comprising a plug insert tool operative in a plug well in the base, the plug insert tool operable by a downward force on the lid press plate to force a plug up into a drain in the pail.

3. The apparatus of claim 2 further comprising a pushrod slidably engaged vertically on the bridge for engagement with the lid press plate after the press plate has started downward.

4. The apparatus of claim 3 further comprising a plug lever pivotally engaged in the base and actuated by the pushrod to push the plug up into the drain.

5. The apparatus of claim 3 wherein said engagement with the lid press plate is by means of a lid press plate handle connected to the press plate, and that engages the pushrod after the lid press plate starts to press the lid onto the pail.

6. The apparatus of claim 1 wherein the lip flange runs around a circumference of the pail.

7. The apparatus of claim 1 comprising four alignment guides, one each edge of the press plate.

8. A method of sealing a resilient container with a lid when the container is full and distended or bowed so that a container lip is not congruent to a lid sealing surface shape, the method comprising the steps of:

a. placing the lid loosely on the container, corners oriented to corners, with at least two respective corners aligned;

b. aligning the container in a container tool;

c. pressing the lid onto the container by applying a downward pressure to the lid while applying an outside in pressure on the bowed sides of the container with a single lid tool;

d. releasing the lid tool; and e. removing the sealed container from the container tool.

9. The method of claim 8 whereby a plug may also be inserted into a drain in the container, further comprising, between the steps c. and d., the step of:

pressing the plug into the drain using the same actuating force used to press the lid onto the container.

* * * * *